US005575419A

United States Patent [19]

Ross et al.

[11] Patent Number: 5,575,419

[45] Date of Patent: Nov. 19, 1996

[54] OPEN-TOP CONTAINER WITH LAMINATED END PANELS

[75] Inventors: John A. Ross; James C. Fogle, both of Marietta, Ga.

[73] Assignee: Riverwood International Corporation, Atlanta, Ga.

[21] Appl. No.: 518,694

[22] Filed: Aug. 24, 1995

[51] Int. Cl.[6] ..... B65D 5/32; B65D 21/032

[52] U.S. Cl. ..... 229/23 R; 229/109; 229/199; 229/916; 229/919

[58] Field of Search ..... 229/23 R, 109, 229/110, 915, 916, 919, 199; 220/416; 206/509, 511, 512

[56] References Cited

U.S. PATENT DOCUMENTS

| | | | |
|---|---|---|---|
| 2,122,654 | 7/1938 | Nickerson | 229/199 |
| 2,162,119 | 6/1939 | Reaume | 229/23 R |
| 2,409,673 | 10/1946 | Glascoff, Jr. et al. | 229/23 R |
| 3,097,781 | 7/1963 | Masi | 229/23 R |
| 3,409,203 | 11/1968 | DuBarry, Jr. | 229/23 R |
| 3,434,648 | 3/1969 | DuBarry, Jr. | 229/23 R |
| 3,713,579 | 1/1973 | Chaffers | 229/23 R |
| 3,934,790 | 1/1976 | Easter | 229/199 |
| 3,946,934 | 3/1976 | Chaffers | 229/23 R |
| 4,142,665 | 3/1979 | Jewell et al. | 229/919 |
| 4,347,968 | 9/1982 | Cornell et al. | 229/23 R |
| 4,884,739 | 12/1989 | Nederveld | 229/109 |
| 5,000,377 | 3/1991 | McClure | 229/919 |
| 5,116,290 | 5/1992 | Ross | 229/109 |
| 5,294,044 | 3/1994 | Clark | 229/919 |
| 5,316,207 | 5/1994 | Ross et al. | 229/109 |

*Primary Examiner*—Gary E. Elkins

[57] ABSTRACT

A container formed by wrapping a slotted flexible sheet about rigid end panels having upper corner projections that extend through the slots. The end panels are formed from a blank having end flaps which are folded and adhered to the main body of the blank to provide double thickness at the end portions. Additional reinforcement may be provided by a reinforcing flap connected to the main body or by a stiffener insert. Stacking projections on the end panels extend through slots in the flexible sheet to maintain the sheet in place.

11 Claims, 4 Drawing Sheets

OPEN-TOP CONTAINER WITH LAMINATED END PANELS

FIELD OF THE INVENTION

This invention relates to packaging and shipping containers which need not be fully enclosed but must be sturdy enough to protect the contents, typically produce, during handling and shipment. More particularly, the invention relates to a container of this type which employs more economical end panels.

BACKGROUND OF THE INVENTION

Articles such as produce ideally should be packaged in containers which protect the contents against bruising or other damage during shipment and handling. The containers should also present an appealing appearance so that they can be used as retail packages after reaching their final destination, and should be economical as well.

One type of container used to package produce is comprised of separate rigid end panels about which a flexible cover sheet is wrapped to form the bottom, side and top panels. The end panels include stacking projections on their upper or lower edge and stacking recesses on their opposite edge. When the containers are stacked, the projections from one container fit into the recesses of the next higher or lower container. The flexible sheet includes slots for receiving the stacking projections and the corners of the end panels. Means are also provided on the end panels for holding the ends of the sheet in place. Typically, the ends of the sheet are spaced from each other to provide a partially open top panel. The containers permit ready circulation of air to maintain the produce fresh and also serve as retail packages after reaching their final destination.

The end panels are typically formed of thick paperboard, pressed board or other readily available rigid material, while the flexible cover sheets are typically formed of paperboard of a thickness normally used in the manufacture of carriers from foldable paperboard blanks. Due to strength requirements the thickness of the end panels is typically several times greater than the thickness of the cover sheet. The end panels thus comprise a very substantial part of the cost of the containers.

A main object of the invention is to provide a produce container which makes use of the basic design concept referred to above but employs end panels which are more economical but nevertheless meet the strength requirements of the container.

BRIEF SUMMARY OF THE INVENTION

The improved container of the invention is based on the type of container discussed above, and includes bottom and side panels formed from a flexible sheet extending between spaced relatively rigid end panels which have upper corner areas and upwardly extending projections inwardly spaced from the corners. The upper corner areas extend through slots in sloped portions of the side panels, and means are provided to secure the flexible sheet to the end panel projections. In accordance with the invention, each end panel is comprised of a main body portion and foldably connected end flaps adhered to end sections of the main body portion so that the end sections and the adhered end flaps form a two-ply structure. In addition, at least the end flaps or the end sections of the main body portion include projections corresponding to the upwardly extending projections.

The end panels may be designed so that both the main body portion and the connected end flaps include aligned projections, or so that only one of them includes projections. Other designs permit the end portions of the end panels to be of three-ply construction. The end panels of the invention provide sufficient strength to withstand loading and shipping stresses, yet are more economical than the usual type of end panel formed from relatively thick rigid material.

These and other features and aspects of the invention, as well as its various benefits, are made more clear in the detailed description of the preferred embodiments which follows.

DETAILED DESCRIPTION OF THE PREFERRED EMBODIMENTS

Figure 1:
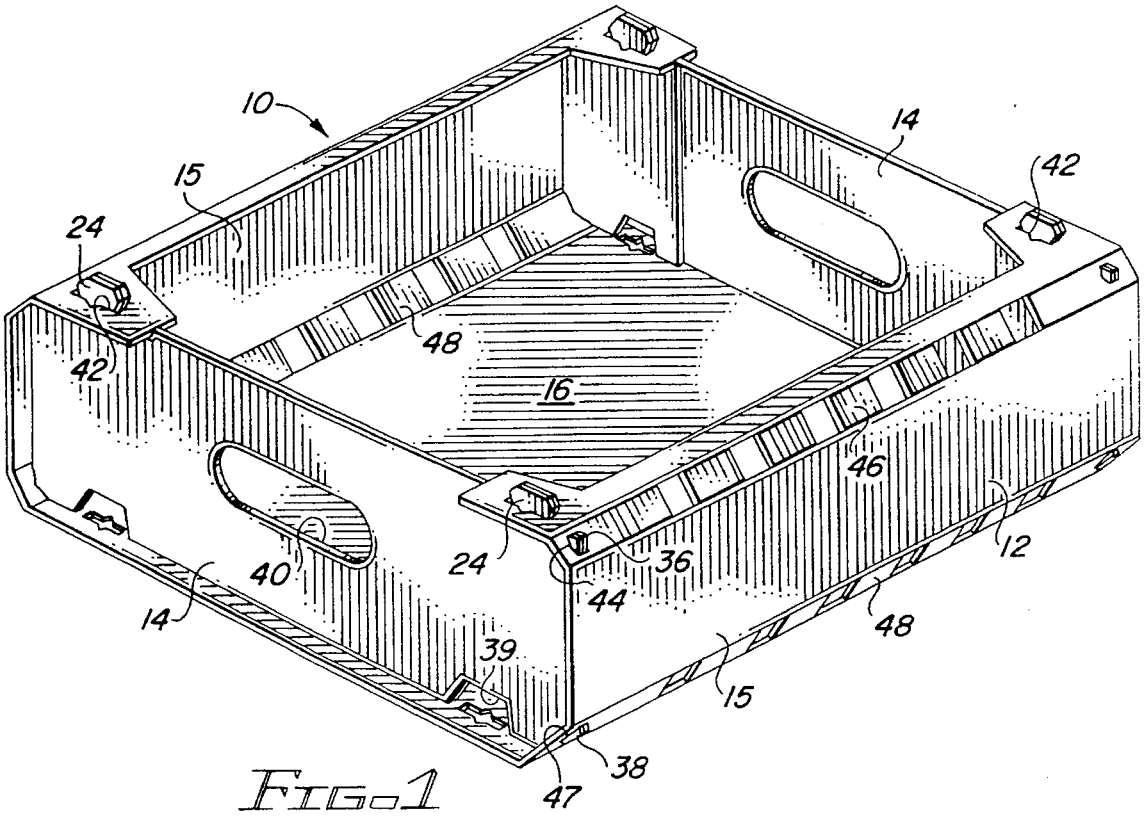
FIG. 1 is a pictorial view of a container embodying the concepts of the invention.

Referring to FIG. 1, a container 10 of the type embodying the concepts of the invention is comprised of a flexible cover sheet 12 and rigid end panels 14. The cover sheet forms the side panels 15 and the bottom panel 16, and is attached to the end panels as described below.

Figure 2:
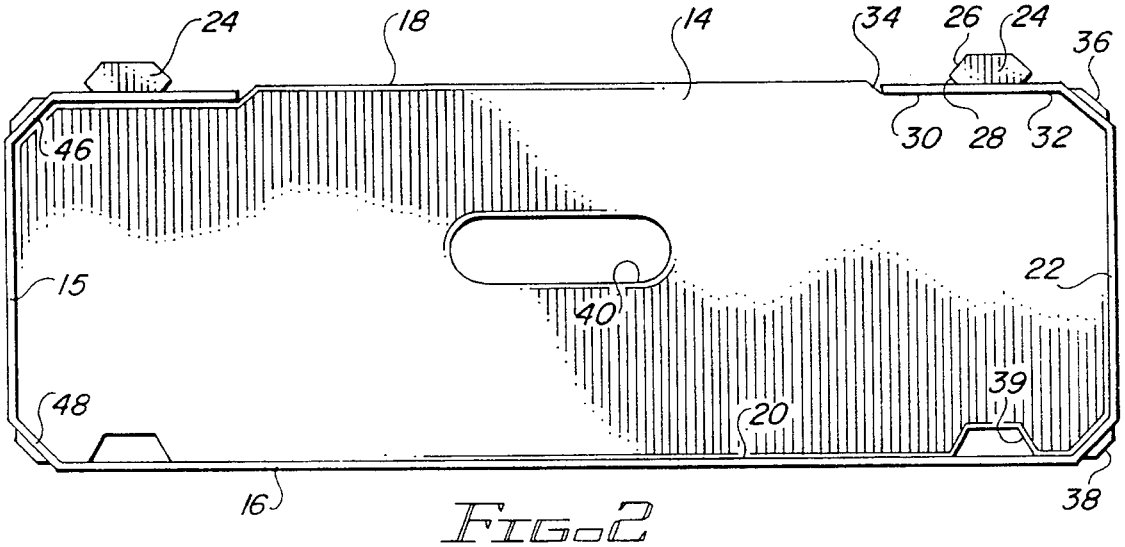
FIG. 2 is an end elevation of the container.

The end panel shown in FIGS. 1 and 2 is of generally rectangular shape, having upper and lower edges 18 and 20, respectively, and side edges 22. Projecting upwardly from the end panel are two spaced stacking projections 24 having side edge portions 26, which taper outwardly to a point slightly above or approximately on the plane of the upper panel edge 18, and side edge portions 28 which taper inwardly for a short distance from the lower end of the side edge portions 26. Adjacent each side of the projections 24 are recesses 30 and 32. Each of the recesses 30 and 32 has a side edge comprised of the tapered projection edge portion 28. The opposite edge 34 of the recess 30 is tapered outwardly, while the recess 32 terminates at tapered shoulder 36, which forms the upper corners of the end panel. The lower corners are also tapered at 38, while the lower edge 20 includes recesses 39 located opposite the projections 24. An opening 40 provides a hand grip for lifting the container and allowing air to flow into the container to keep packaged produce in fresh condition. As described in more detail below, the end panels are not thick single-ply panels as in conventional produce carriers, but are laminated panels comprised of at least two layers of relatively low caliper.

Still referring to both FIGS. 1 and 2, the stacking projections 24 extend up through slots 42 in the cover sheet to hold the ends of the cover sheet in place, while the upper tapered shoulders 36 of the end panels extend through slots 44 in upper bevel panels 46. The lower tapered shoulders 38 extend through slots 47 in lower bevel panels 48. As can be seen in FIG. 1, the stacking projections 24 and the upper and lower corners 36 and 38 of the end panels are of two-ply construction, while the body of the end panels between the recesses 30 is of single-ply construction.

Figure 3:
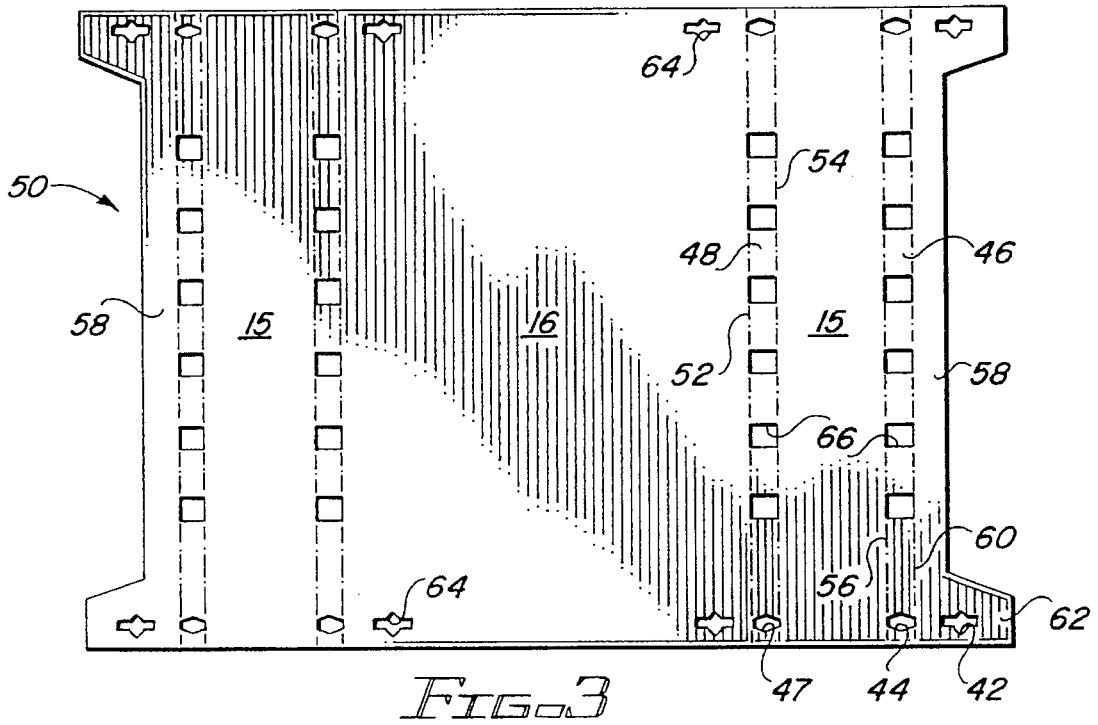
FIG. 3 is a plan view of the blank used in forming the container of FIG. 1.

The blank 50 used to form the cover sheet of the container of FIG. 1 is shown in FIG. 3, wherein similar reference numerals to those used in FIG. 1 denote similar elements. The blank includes a series of parallel fold lines which allow the sheet to be folded about the end panels to form the bottom, side, top and bevel panels of the container. Thus, the centrally located bottom panel section 16 is connected by fold lines 52 to lower bevel panel sections 48, which in turn are connected by fold lines 54 to side panel sections 15. Upper bevel panel sections 46 are connected to the side panel sections 15 by fold lines 56 and to narrow top panel sections 58 by fold lines 60. The end portions of the top panel sections extend outwardly to form locking tabs 62. The locking tabs include the slots 42 for receiving the projections 24 of the end panels, and the upper bevel panel sections 46 include the slots 44 for receiving the upper corner shoulders 36 of the end panels. In addition, the lower bevel panel sections 48 include the slots 47 for receiving the lower corner shoulders 38 of the end panels. Also, slots 64 are provided in the bottom panel section 16 to allow passage of the stacking projections of the next lower container in a stacked arrangement. A number of air flow openings 66 are provided in the bevel panel sections which, in addition to providing for air flow over packaged produce, interrupt the fold lines of the bevel panel sections, thus shortening the fold lines to facilitate folding the sections when forming the container.

Figure 4:
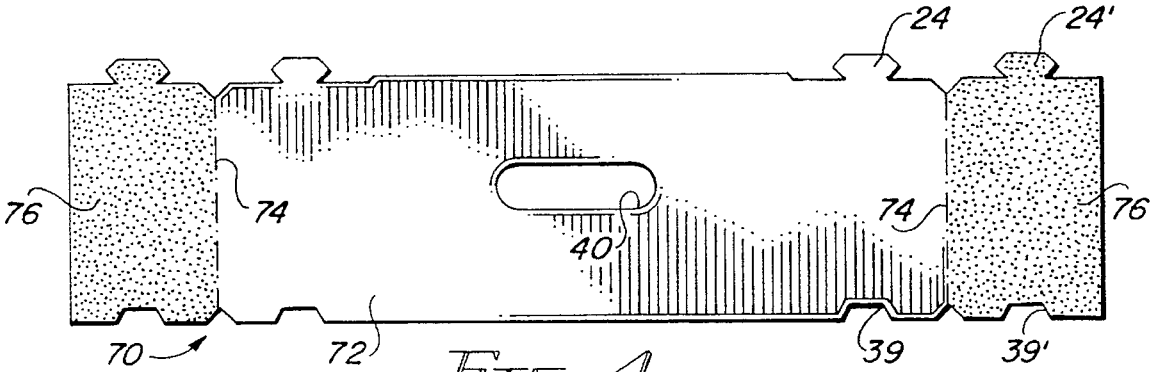
FIG. 4 is a plan view of a blank for forming the end panels of the container.

Referring to FIG. 4, a blank 70 for forming the end panel 14 of the container includes a main body portion 72 which is identical in shape and size to the end panel 14. The components of the main body portion which are similar to the components of the end panel 14 bear the same reference numerals. Instead of the body section terminating at the side edges of the end panel, however, it terminates in vertical fold lines 74 which connect the main body portion 72 to end reinforcing flaps 76. The flaps 76 include stacking projections 24' which are similar to, but reversed from, the projections 24.

Figure 5:
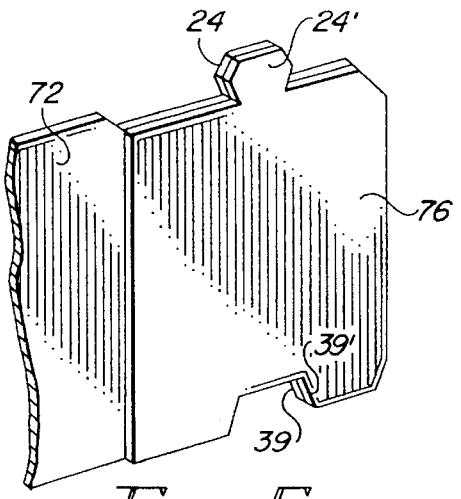
FIG. 5 is a partial pictorial view of the blank of FIG. 4 after it has been folded to form an end panel.

To form an end panel 14, the flaps 76 of the blank 70 are folded in about the fold lines 74 and adhered to the main body portion 72 by glue, as indicated by the stippling in FIG. 4. This results in the end panel arrangement of FIG. 5, in which the two-ply nature of the end portions of the end panel, including the stacking projections and the stacking recesses, can best be seen. This construction increases the strength of the end portions of the end panels, which are the most highly stressed areas of the end panels of the container, but employs a minimum of paperboard. The laminated construction of the end panels is considerably more economical than the typical rigid webs conventionally employed as the end panels, yet provides the container with adequate strength.

Figure 6:
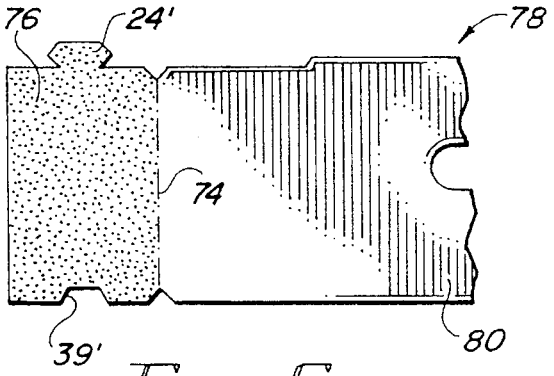
FIG. 6 is a plan view of a modified end panel blank.
Figure 7:
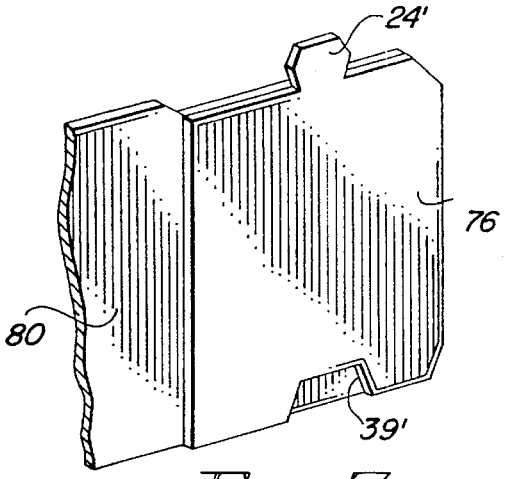
FIG. 7 is a partial pictorial view of the blank of FIG. 6 after it has been folded to form a modified end panel.

One end of a modified end panel blank 78 is illustrated in FIG. 6, which includes a flap 76 identical to the flap 76 of FIG. 4 incorporating a stacking projection 24' and a stacking recess 39'. The main body 80 of the blank is similar to the main body 72 of FIG. 4, except that it does not include stacking projections or stacking recesses. When the flaps are folded and glued to the main body portion of the blank, the resulting end panel, shown in FIG. 7, is comprised of a main body portion of single-ply construction and end portions of two-ply construction. Unlike the end panel of FIG. 5, the end panel of FIG. 7 has stacking projections and stacking recesses of only single-ply construction. Since the two-ply end portions satisfy the strength requirements of the container, and since the alignment function of the stacking projections when inserted into the stacking recesses of the next higher container in a stack require only minimal strength, the single-ply construction is entirely adequate. The stresses exerted on the stacking projections by their engagement with the slots 42 of the top panel locking tabs are adequately resisted by the single-ply projections since the forces involved are concentrated primarily at the edges of the projections, parallel to the face of the projections, and are not concentrated at the much more susceptible projection faces.

Figure 8:
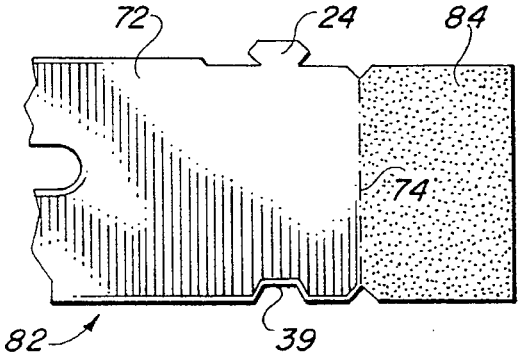
FIG. 8 is a plan view of another modified end panel blank.
Figure 9:
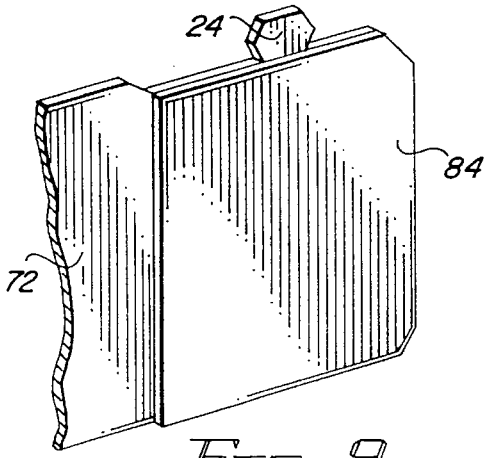
FIG. 9 is a partial pictorial view of the blank of FIG. 8 after it has been folded to form another modified end panel.

Another modified end panel blank is shown in FIG. 8 at 82. In this design the main body portion 72 is identical to the main body portion 72 of FIG. 4. The end flap 84 connected to the main body portion by fold line 74 does not include a stacking projection or stacking recess. The structure resulting from folding and gluing the end flaps 84 to the main body of the blank is illustrated in FIG. 9. As in the other end panels, the main body portion is of single-ply construction and the end portions are of two-ply construction. The arrangement is similar to that of FIG. 7 in that the stacking projections and stacking recesses are of single-ply construction. Note that the stacking recess 39 is hidden in the view of FIG. 9 by the folded flap 84.

Figure 10:
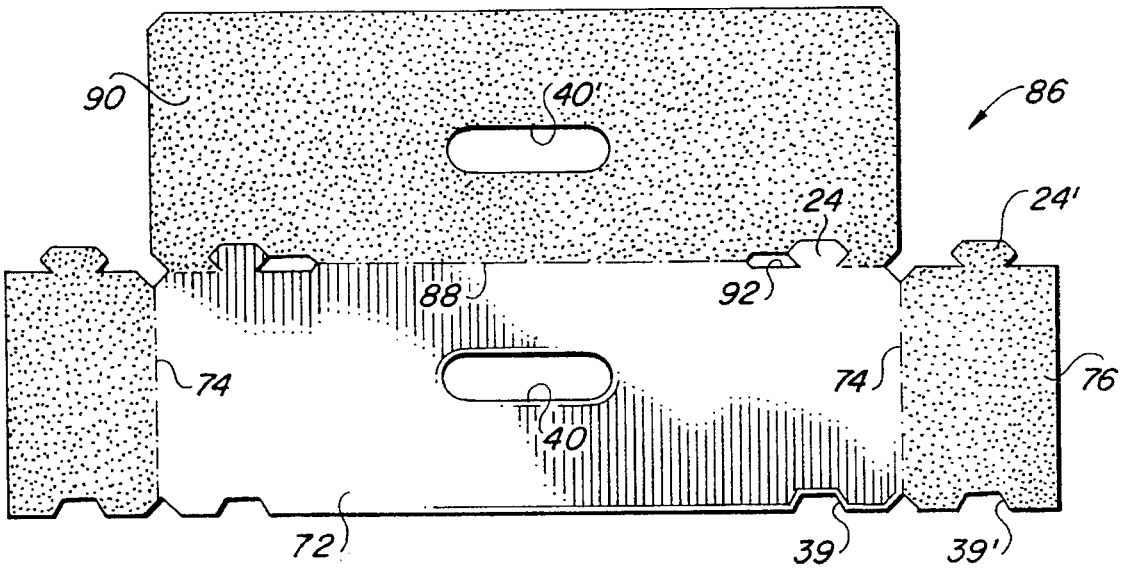
FIG. 10 is a plan view of a further modified end panel blank.

If the strength requirements of a particular container dictate that the end panels be of even greater strength, an additional ply of material may be connected to the main body portion of the end panel blank. The blank 86 of FIG. 10 is an example of such an arrangement. In this embodiment the main body portion 72 and the end flaps 76 are similar to the structure of the blank 70 shown in FIG. 4. Connected to the upper edge of the body portion 72 along fold line 88 is reinforcement flap 90. The flap 90 includes a handle opening 40' similar to handle opening 40. Cutouts 92 extend from the ends of the fold line 88 to the ends of the flap 90. Although the cutouts can extend into the flap 90 for any desired distance, it is preferred to maximize the area of the additional ply of material while at the same time minimizing any chance of interference with the folding operation by terminating the cutouts at the upper edge of the projections 24.

Figure 11:
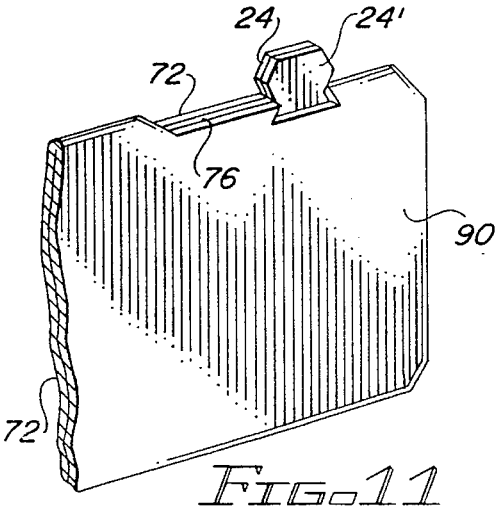
FIG. 11 is a partial pictorial view of the blank of FIG. 10 after it has been folded to form a further modified end panel.

To form an end panel from the blank 86 the end flaps 76 are folded in and glued to the main body portion 72, after which the flap 90 is folded down and glued to the main body portion 72 and the folded flaps 76. The stippled areas on the blank indicate the areas to be glued. FIG. 11 illustrates the end portion of the resulting panel. The projections 24 and 24' combine to form a two-ply projection, while the recesses 39 and 39' which are not visible in this view, form a two-ply recess. The main body portion is of two-ply construction formed by the main body portion 72 and the flap 90, and the end portions are of three-ply construction due to the presence of the flaps 76. Although this arrangement utilizes an additional ply of material and is therefore more costly than the previous embodiments, the cost is still less than that of a rigid web of a thickness to withstand the expected stresses.

Figure 12:
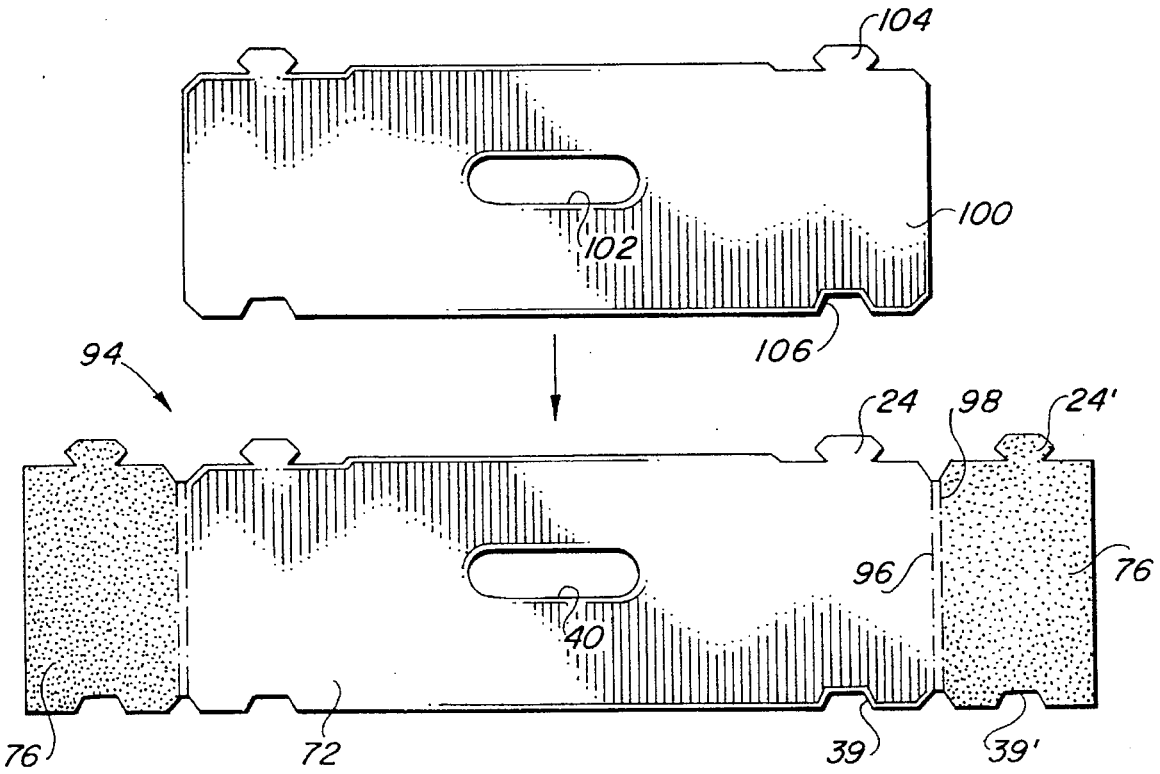
FIG. 12 is a plan view of another modified end panel blank designed to be used with a stiffening insert.

Even though the end panels are formed from relatively thin paperboard compared to the relatively thick, rigid end panels of the prior art, this construction provides end panel strength which is normally adequate to resist the stresses to which it is subjected during use. If, however, it is found that the end panels require even greater strength, as when the container is expected to be subjected to excessively high forces or when the paperboard from which the end panels are formed is of very low caliper, the end panels may be further reinforced by employing a stiffener insert. Such an arrangement is illustrated in FIG. 12, wherein a separate relatively thick insert and a triple thick arrangement at the ends of the end panels are provided. The blank 94 is comprised of a main body portion 72 and end flaps 76 identical to the blank 70 of FIG. 4, except that instead of the end flaps being connected to the main body portion by a single fold line, they are connected by slightly spaced parallel fold lines 96 and 98. A separate insert 100 is provided which is substantially identical in shape and size to the main body portion 72, including a handle opening 102, stacking projections 104 and stacking recesses 106.

To form an end panel from the blank and insert of FIG. 12 the insert is aligned with and placed on the main body portion 72, after which the end flaps 76 are folded into place and glued to the insert. Since an insert would be employed only in those situations where the strength requirements of the end panels of a container are quite severe, it is anticipated that the insert would be thicker than the ply of the blank 94. The spaced fold lines 96 and 98 are provided to compensate for that thickness, with the area between the fold lines corresponding to the edge of the insert.

Figure 13:
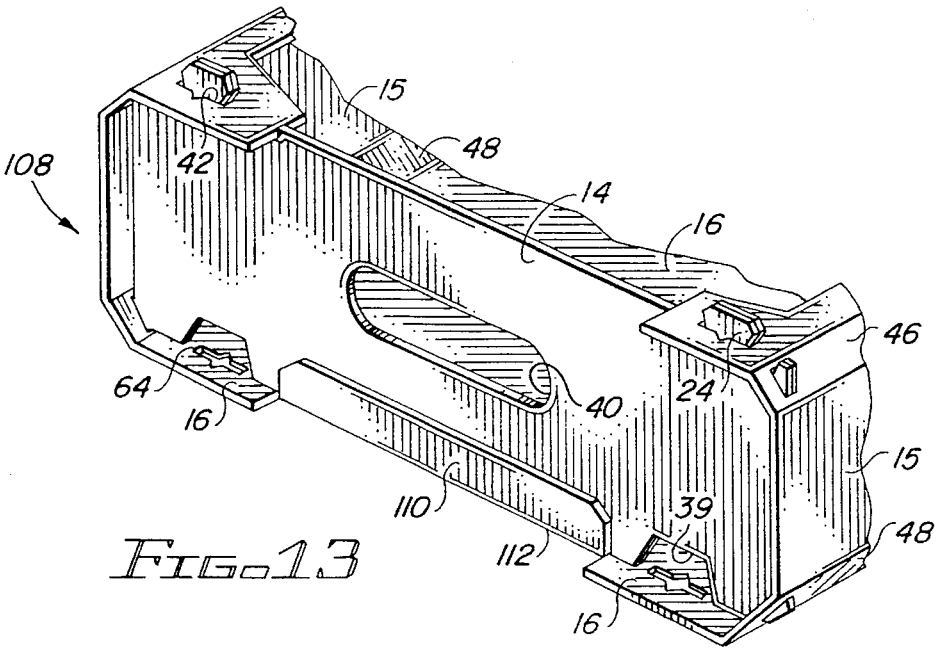
FIG. 13 is a partial pictorial view of one end of a modified container.

A modified container 108, shown in FIG. 13, is similar to the container of FIG. 1 except for the design of the ends of the bottom panel. The bottom panel 16 in this arrangement includes a glue flap 110 at either end of the bottom panel connected by fold line 112. The provision of glue flaps permits the end panels or webs 14 to be adhered to the glue flaps prior to assembly of the container, so that the container can be shipped in blank form with the end panels attached. Assembly of the container may proceed as described in connection with the container of FIG. 1. Note that the glue flap is relatively narrow, which leaves intact the slots 64 in the bottom panel and does not interfere with access to the projection recesses 39.

Although the container of the invention has been shown for the purpose of illustration as being comprised of a single bin formed by the space between the two end panels, it is within the scope of the invention to provide one or more interior cross panels to divide the container into multiple bins, if desired. It will be appreciated that the thickness of the various plies of material have been exaggerated in the drawing in order to illustrate their presence, and that the plies of an actual container would be substantially thinner relative to the other dimensions of the container.

In summary, the invention provides an end panel which can be formed from a single blank and yet provide for double or triple thicknesses at the end portions of the panel. It should be obvious that although preferred embodiments of the invention have been described, changes to certain details of the embodiments can be made without departing from the spirit and scope of the invention defined in the appended claims.

What is claimed is:

1. In a container comprised of:

two spaced, substantially parallel, relatively rigid end panels;

each end panel having two spaced upper corner areas and two upwardly extending projections, each projection being inwardly spaced from one of the upper corner areas;

a flexible sheet forming bottom and side panels extending between the end panels;

each side panel including an upper inwardly sloped portion;

the upper corner areas of the end panels extending through slots in the upper sloped portions; and means for securing end portions of the flexible sheet to associated of said end panel projections;

the improvement comprising:

each end panel having a main body portion and foldably connected end flaps adhered to end sections of the main body portion, the end sections and the adhered end flaps forming a two-ply structure;

the projections of each end panel being of two-ply construction, one of the plies of the projections of each end panel being comprised of projections extending upwardly from the end sections of the main body portion and the other ply of the projections of each end panel being comprised of projections extending upwardly from the end flaps.

2. The improvement of claim 1, wherein both the end sections of the main body portion of each end panel and the end flaps connected thereto include lower corner areas and aligned recesses inwardly spaced from the lower corner areas, the recesses being located opposite associated of said end panel projections.

3. In a container comprised of:

two spaced, substantially parallel, relatively rigid end panels;

each end panel having two spaced upper corner areas and two upwardly extending projections, each projection being inwardly spaced from one of the upper corner areas;

a flexible sheet forming bottom and side panels extending between the end panels;

each side panel including an upper inwardly sloped portion;

the upper corner areas of the end panels extending through slots in the upper sloped portions; and means for securing end portions of the flexible sheet to associated of said end panel projections;

the improvement comprising:

each end panel having a main body portion and foldably connected end flaps adhered to end sections of the main body portion, the end sections and the adhered end flaps forming a two-ply structure;

the projections of each end panel being of single-ply construction, the single ply being comprised of projections extending upwardly from the end flaps.

4. The improvement of claim 3, wherein the end sections of the main body portion of each end panel and the end flaps connected thereto include lower corner areas, the end flaps including recesses inwardly spaced from the lower corner areas and being located opposite associated of said end panel projections, the end sections of the main body portion of each end panel being devoid of recesses aligned with the recesses in the end flaps.

5. In a container comprised of:

two spaced, substantially parallel, relatively rigid end panels;

each end panel having two spaced upper corner areas and two upwardly extending projections, each projection being inwardly spaced from one of the upper corner areas;

a flexible sheet forming bottom and side panels extending between the end panels;

each side panel including an upper inwardly sloped portion;

the upper corner areas of the end panels extending through slots in the upper sloped portions; and means for securing end portions of the flexible sheet to associated of said end panel projections;

the improvement comprising:

each end panel having a main body portion and foldably connected end flaps adhered to end sections of the main body portion, the end sections and the adhered end flaps forming a two-ply structure;

the projections of each end panel being of single-ply construction, the single ply being comprised of projections extending upwardly from end sections of the main body portion.

6. The improvement of claim 5, wherein the end sections of the main body portion of each end panel and the end flaps connected thereto include lower corner areas, the end sections of the main body portion of each end panel including recesses inwardly spaced from the lower corner areas and being located opposite associated of said end panel projections, the end flaps being devoid of recesses aligned with the recesses in the end sections of the main body portion.

7. In a container comprised of:

two spaced, substantially parallel, relatively rigid end panels;

each end panel having two spaced upper corner areas and two upwardly extending projections, each projection being inwardly spaced from one of the upper corner areas;

a flexible sheet forming bottom and side panels extending between the end panels;

each side panel including an upper inwardly sloped portion;

the upper corner areas of the end panels extending through slots in the upper sloped portions; and means for securing end portions of the flexible sheet to associated of said end panel projections;

the improvement comprising:

each end panel having a main body portion, foldably connected end flaps adhered to end sections of the main body portion and a reinforcement flap foldably connected to the main body portion between the projections;

the end sections, the adhered end flaps and the reinforcement flap forming a three-ply structure;

the projections of each end panel being of two-ply construction, one of the plies of the projections of each end panel being comprised of projections extending upwardly from the end sections of the main body portion and the other ply of the projections of each end panel being comprised of projections extending upwardly from the end flaps.

8. The improvement of claim 7, wherein both the end sections of the main body portion of each end panel and the end flaps connected thereto include lower corner areas and aligned recesses inwardly spaced from the lower corner areas, the recesses being located opposite associated of said end panel projections.

9. In a container comprised of:

two spaced, substantially parallel, relatively rigid end panels;

each end panel having two spaced upper corner areas and two upwardly extending projections, each projection being inwardly spaced from one of the upper corner areas;

a flexible sheet forming bottom and side panels extending between the end panels;

each side panel including an upper inwardly sloped portion;

the upper corner areas of the end panels extending through slots in the upper sloped portions; and means for securing end portions of the flexible sheet to associated of said end panel projections;

the improvement comprising:

each end panel having a main body portion, a separate stiffener insert of substantially the same size as the main body portion and end flaps foldably connected to end sections of the main body portion, the end flaps being adhered to the stiffener insert;

the end sections, the stiffener insert and the end flaps forming a three-ply structure;

the projections of each end panel being of at least two-ply construction, one of the plies of the projections of each end panel being comprised of projections extending upwardly from the stiffener insert and the other ply of the projections of each end panel being comprised of projections extending upwardly from either the end flaps or the end sections of the main body portion.

10. The improvement of claim 9, wherein the insert and at least the end flaps or the end sections of the main body portion include lower corner areas and aligned recesses inwardly spaced from the lower corner areas, the recesses being located opposite associated of said end panel projections.

11. The improvement of claim 9, wherein the end flaps are connected to the main body of each end panel by spaced parallel fold lines, the distance between fold lines substantially corresponding to the thickness of the insert to which the end flaps are adhered.

* * * * *